US011127248B2

(12) United States Patent
Yang

(10) Patent No.: US 11,127,248 B2
(45) **Date of Patent: *Sep. 21, 2021**

(54) SOCIAL INTERACTIVE WAGERING SYSTEM

(71) Applicant: eBay Inc., San Jose, CA (US)

(72) Inventor: York Yang, Shanghai (CN)

(73) Assignee: eBay Inc., San Jose, CA (US)

( * ) Notice: Subject to any disclaimer, the term of this patent is extended or adjusted under 35 U.S.C. 154(b) by 132 days.

This patent is subject to a terminal disclaimer.

(21) Appl. No.: 16/256,086

(22) Filed: Jan. 24, 2019

(65) Prior Publication Data

US 2019/0156622 A1 May 23, 2019

Related U.S. Application Data

(63) Continuation of application No. 14/514,347, filed on Oct. 14, 2014, now Pat. No. 10,198,899.

(51) Int. Cl.

| | |
|---|---|
| ***G07F 17/00*** | (2006.01) |
| ***G07F 19/00*** | (2006.01) |
| ***G07F 17/32*** | (2006.01) |
| *G07F 17/34* | (2006.01) |

(52) U.S. Cl.

CPC ..... *G07F 17/3225* (2013.01); *G07F 17/326* (2013.01); *G07F 17/3218* (2013.01); *G07F 17/34* (2013.01)

(58) Field of Classification Search

CPC ..... G07F 17/3288

See application file for complete search history.

(56) References Cited

U.S. PATENT DOCUMENTS

| | | | | |
|---|---|---|---|---|
| 5,749,785 | A * | 5/1998 | Rossides | G06Q 50/34 463/25 |
| 6,508,710 | B1 | 1/2003 | Paravia et al. | |
| 8,292,741 | B2 | 10/2012 | Burman et al. | |
| 8,414,387 | B1 | 4/2013 | Paradise et al. | |
| 8,876,610 | B1 | 11/2014 | Curtis et al. | |
| 9,430,909 | B2 | 8/2016 | Shore et al. | |
| 10,198,899 | B2 | 2/2019 | Yang | |
| 2002/0073021 | A1 | 6/2002 | Ginsberg | |
| 2002/0111213 | A1 | 8/2002 | McEntee et al. | |
| 2003/0157976 | A1 | 8/2003 | Simon et al. | |

(Continued)

OTHER PUBLICATIONS

Non-Final Office Action received for U.S. Appl. No. 14/514,347, dated Dec. 2, 2016, 13 pgs.

(Continued)

*Primary Examiner* — Milap Shah

(74) *Attorney, Agent, or Firm* — Schwegman Lundberg & Woessner, P.A.

(57) ABSTRACT

A system and method includes one or more processors coupled to a memory, the one or more processors operable to read instructions from the memory to perform one or more steps or operations. The operations may include receiving a signal from a first device, sending a first code and an instruction to broadcast the code to a broadcasting device based on the signal, receiving an access request and a second code broadcasted from the broadcasting device from a second user device, and granting the second user device access to a feature of an application when the second code broadcasted from the broadcasting device matches the first code.

20 Claims, 10 Drawing Sheets

(56) References Cited

U.S. PATENT DOCUMENTS

| | | | | |
|---|---|---|---|---|
| 2003/0236120 | A1 | 12/2003 | Reece et al. | |
| 2004/0128157 | A1 | 7/2004 | Aquilino et al. | |
| 2004/0203896 | A1 | 10/2004 | Deigin et al. | |
| 2006/0172803 | A1 | 8/2006 | Hardy et al. | |
| 2006/0287094 | A1 | 12/2006 | Mahaffey et al. | |
| 2007/0054739 | A1 | 3/2007 | Amaitis et al. | |
| 2007/0087832 | A1 | 4/2007 | Abbott et al. | |
| 2007/0197247 | A1 | 8/2007 | Inselberg | |
| 2008/0039192 | A1 | 2/2008 | Laut | |
| 2008/0058094 | A1 | 3/2008 | Amaitis et al. | |
| 2008/0076572 | A1 | 3/2008 | Nguyen et al. | |
| 2008/0096628 | A1 | 4/2008 | Czyzewski et al. | |
| 2008/0102956 | A1 | 5/2008 | Burman et al. | |
| 2008/0108437 | A1 | 5/2008 | Kaarela et al. | |
| 2009/0270155 | A1* | 10/2009 | Glass | G07F 17/3288 463/16 |
| 2009/0298577 | A1 | 12/2009 | Gagner et al. | |
| 2010/0069144 | A1 | 3/2010 | Curtis et al. | |
| 2010/0105464 | A1 | 4/2010 | Storm et al. | |
| 2010/0321499 | A1 | 12/2010 | Ortiz et al. | |
| 2011/0281620 | A1 | 11/2011 | Hays | |
| 2012/0028718 | A1 | 2/2012 | Barclay et al. | |
| 2012/0058813 | A1 | 3/2012 | Amaitis et al. | |
| 2012/0214575 | A1 | 8/2012 | Amaitis et al. | |
| 2014/0011575 | A1 | 1/2014 | Neubauer et al. | |
| 2014/0024435 | A1 | 1/2014 | Scott | |
| 2014/0194192 | A1 | 7/2014 | Pierce, II et al. | |
| 2014/0200062 | A1 | 7/2014 | Paradise et al. | |
| 2014/0357346 | A1 | 12/2014 | Ordish et al. | |
| 2015/0262456 | A1 | 9/2015 | Shore et al. | |
| 2016/0140804 | A1 | 5/2016 | Morgan | |

OTHER PUBLICATIONS

Response to Non-Final Office Action filed Mar. 2, 2017 for U.S. Appl. No. 14/514,347, 14 pgs.
Final Office Action received for U.S. Appl. No. 14/514,347, dated May 23, 2017, 10 pgs.
Response to Final Office Action filed Sep. 13, 2017 for U.S. Appl. No. 14/514,347, 9 pgs.
Non-Final Office Action received for U.S. Appl. No. 14/514,347, dated Oct. 19, 2017, 9 pgs.
Applicant Initiated Interview Summary received for U.S. Appl. No. 14/514,347, dated Jan. 8, 2018, 3 pgs.
Response to Non-Final Office Action filed Jan. 19, 2018, for U.S. Appl. No. 14/514,347, 10 pgs.
Final Office Action received for U.S. Appl. No. 14/514,347, dated May 17, 2018, 8 pgs.
Response to Final Office Action filed Jul. 17, 2018, for U.S. Appl. No. 14/514,347, 10 pgs.
Notice of Allowance received for U.S. Appl. No. 14/517,347, dated Sep. 20, 2018, 7 pgs.

* cited by examiner

Odds Module
Method 800

Payout Module
Method 900

SOCIAL INTERACTIVE WAGERING SYSTEM

CROSS-REFERENCE TO RELATED APPLICATIONS

This patent application is a continuation application that claims the benefit of the filing date of U.S. patent application Ser. No. 14/514,347, filed Oct. 14, 2014, now U.S. Pat. No. 10,198,899, issued Feb. 5, 2019, and entitled "SOCIALLY INTERACTIVE WAGERING SYSTEM" which is incorporated herein by reference in its entirety.

BACKGROUND

Field of the Disclosure

The present disclosure generally relates to facilitating social groups, and more particularly to systems and methods for facilitating wagers between users within a social group.

Related Art

With the advent of the internet, online services have become ubiquitous in all aspects of business. Although the internet has simplified many tedious tasks, it has also reduced the enjoyable and social aspects of some of those tasks. Some examples include purchasing tickets for an event. Before online ticket purchasing was available, purchasing tickets for concerts, sporting events, theatre, and so forth would require individuals to travel to an authorized dealer and wait in a line. Sometimes, for a particularly popular event, individuals would camp out at a ticket dealer.

While individuals are still able to buy tickets in person, most prefer to purchase tickets online out of convenience. Purchasing tickets online avoids traveling and lines. However, purchasing tickets online removes opportunities for people to connect. When waiting in line for an exciting event, an engaging social interaction often develops through the shared interest and excitement for the event. For reasons such as boredom and the desire for human interaction, complete strangers in line will often form into small social groups and chat to pass the time. These groups create intimate on-the-fly social interactions that are absent when purchasing tickets online. Purchasing tickets online is generally a lonely and cold experience, especially when there is no one around to share in the excitement. Thus, an opportunity to form camaraderie with strangers through a shared interest is lost.

Furthermore, attending an event usually does not promote the same sort of social interactions that occur when standing in lines. This may be due to several reasons. For example, stadiums and concert halls are generally efficiently planned to pack as many people as possible in a venue. By creating crowded areas, there are too many people in the immediate vicinity to strike up a conversation. Attendees may find striking up a conversation difficult at an event because the crowded environment may be loud. Furthermore, people may give the impression that they are preoccupied because they are facing an arena or a stage.

There are also other factors that cause attending an event to be less conducive for spontaneous social interactions. Events usually play music and other forms of entertainment which removes some of the boredom that may exist in a line. Furthermore, events are usually attended in a group which creates a barrier to social interactions with strangers. In contrast, a single group member will often stand in line on behalf of a group such that the same social barrier does not exist.

In a similar vein, aspects of gambling have also become impersonal since the advent of the internet. For example, people often wager on the outcome of an event, such as a sporting event, to add suspense. Wagering on events can also be a very social affair that can nurture camaraderie among individuals. The process of negotiating betting odds, triggering actions for a wager, and so forth can be very engaging for the participants.

Several websites have enabled gambling on the internet. However, these websites only focus on the monetary aspects of gambling. These websites are designed to efficiently generate income rather than provide a form of entertainment. These websites usually provide limited preset choices of betting options, and bets are often against the house. For example, for a Super Bowl game, these websites may offer limited options for placing wagers. The individual may only have the option to either bet on the winner or the winner within a certain score (as the spread and/or handicap). Furthermore, because all bets are against the house, the house ensures a profit by setting odds against the wagering individuals on any side of a bet. Astute individuals may shy away from such activities when they know that the odds are stacked against them. Furthermore all the normal social interactions that may exist between individuals in person do not exist in online gambling. Individuals are not usually able to wager against each other through these online websites. Online gambling, thus, may leave an individual with a cold and impersonal experience, especially when they lose.

Transitioning many aspects of a business online has also impacted brand loyalty. Brand loyalty often develops through good will and exceptional customer service. Some individuals may be willing to pay more or recommend a brand based on the individual experience with the brand. By conducting businesses online, customer experiences are generally similar across all websites.

Businesses may have difficulty in providing a service online that is significantly distinguished from a competitor. So long as a business's website, such as a ticket selling/exchange website, has a clean and intuitive user interface, individuals may not develop loyalty to any one website.

Thus a system and method that brings back some of the social interactions through a common interest would be desirable. Furthermore these features that spur social interactions may make a sufficient impact on customer experiences to improve brand loyalty.

Figure 1:
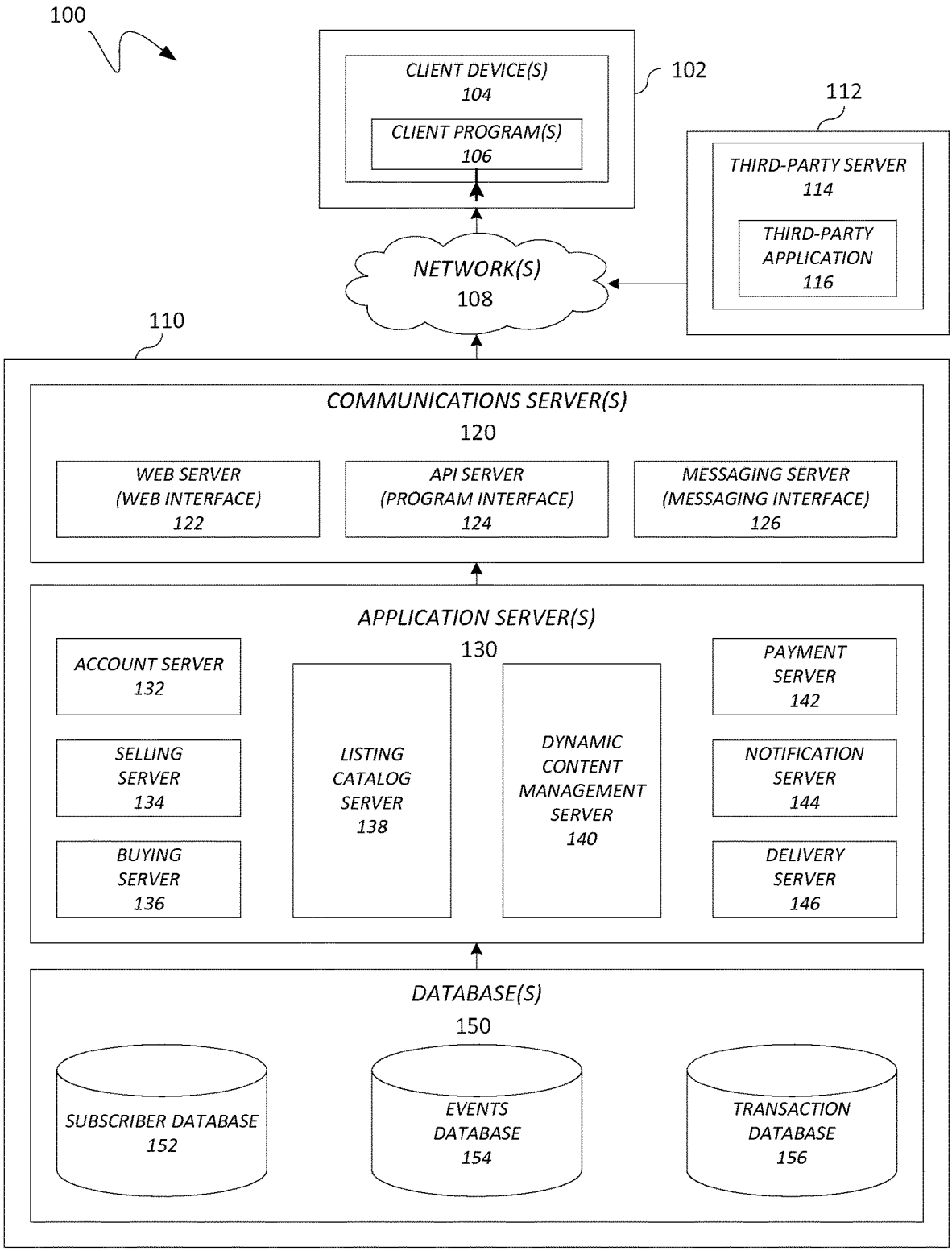
FIG. 1 is a block diagram of an example computing system that is adapted for implementing a socially interactive wagering system.

Embodiments of the present disclosure and their advantages are best understood by referring to the detailed description that follows. It should be appreciated that like reference numerals are used to identify like elements illustrated in one or more of the figures, wherein showings therein are for purposes of illustrating embodiments of the present disclosure and not for purposes of limiting the same.

DETAILED DESCRIPTION

In the following description, specific details are set forth describing some embodiments consistent with the present disclosure. It will be apparent, however, to one skilled in the art that some embodiments may be practiced without some or all of these specific details. The specific embodiments disclosed herein are meant to be illustrative but not limiting. One skilled in the art may realize other elements that, although not specifically described here, are within the scope and the spirit of this disclosure. In addition, to avoid unnecessary repetition, one or more features shown and described in association with one embodiment may be incorporated into other embodiments unless specifically described otherwise or if the one or more features would make an embodiment non-functional.

In some embodiments, a method and system are provided for encouraging social interactions between individuals when attending and/or viewing an event. In some embodiments, the system and method may inspire interactions between individuals attending and/or viewing an event by one or more combination of services that may include, but are not limited to, designating social groups, providing an entertaining and/or competitive activity, and/or locating participants within an individual's social group.

The description includes a system and method that encourages patrons and/or fans of an event to interact with each other through creative bets. Among other features, this description discloses a way for individuals to limit wagering interactions to small groups and foster social interactions. By allowing wagers to be limited to people within certain areas, such as a seating area, an event venue, a bar, and/or the like, participants within each group are encouraged to connect on a personal level. Furthermore, the wagering system may allow wagers between individuals rather than against a "house" (e.g. a casino) such that wagers are more likely to have a neutral expected value.

In some embodiments, the groups are created by sending codes and/or configurations to a certain area through a broadcasting device, such as a beacon. The beacon may have a limited range such that only devices within a particular venue and/or seating area can receive the codes and/or configurations. In this manner, the individuals that have devices with the same codes and/or configurations may participate in wagering with each other. Other restrictions may be used, alone or in conjunction, to set up groups. Other restrictions include, but are not limited to, friends on a social media website, people within a contact list, and/or the like.

Additionally, by allowing participants to restrict wagers to certain areas and/or groups of people, professional gamblers will have difficulty in taking advantage of social gamblers. The professional gamblers would have to be at the venue, in a particular seating area, within a certain social group, and/or abide by any other wager restrictions to participate in a wager.

Furthermore, participants are provided with the ability to make creative non-traditional wagers. The users may be provided with a graphical user interface that provides drop down menus which narrow the limitations of a wager by each selection until a wager is sufficiently delineated to a polarized trigger (e.g. win or lose). For example, a first drop down menu may request the event type, such as a sport. After selecting the sport, another drop down menu may appear requesting a particular event or game, such as team 1 versus team 2 on December 2 of this year. After selecting the event or game, another drop down menu may request the selection of a team and/or a player name. After selecting a team and/or a player name, another additional drop down menu may appear requesting selection of an event statistic such as score, win, lose, fouls, red card, and/or the like. In some cases the selection of one of these statistics may sufficiently delineate a wager to a polarizing event that may serve as a trigger to a wager, such as win or lose. In some cases the selection may require additional delineation of the wager, such as the selection of foul may require the number of fouls and a time limit for the number of fouls, such as 3 fouls by the end of the third quarter.

In additional to providing participants the enjoyment of creating fun non-traditional wagers, this feature also deters professional gamblers. Professional gamblers generally find edges in wagers through rigorous statistical analysis. Therefore, the professional gamblers may focus on certain teams for certain outcomes, for example, the odds that team 1 will beat team 2 within a certain score. However, because of the many combinations that can be used to create a wager, professional gamblers will be unable to conduct rigorous analysis on all of the different wagering possibilities. Furthermore, professional gambles will be relatively inexperienced in determining the odds for a non-traditional wager, such as whether a player will foul three times by the end of the third quarter of a game. Thus, professional gamblers may find it difficult to find a competitive edge in such a wagering system and/or method.

This disclosure also includes a system and method for individuals participating in wagers to communicate with each other. The system and method may add an in-person social aspect to the wagers by encouraging participants to settle bets in person. By inspiring in-person bet settlements, participants are encouraged to develop friendships and camaraderie with other fans. The systems and methods disclosed herein may also include a personal safety feature which lets the participants choose not to meet in person and/or limit in-person meetings to safe areas.

Furthermore, participants may be able to communicate with each other through a messaging application, chat application, video chat application, and/or the like. The system and method may add additional entertainment to participants by allowing participants on opposing sides of a wager to banter with each other. By adding in applications for chat, video chat, and/or the like, the system and method can escalate comfort among the participants with small steps that lead to an in-person meeting.

This disclosure also includes a system and method for automatically calculating odds for a wager. Individuals new to betting and wagering may be uncomfortable with setting odds for a wager. The individuals may feel more comfortable having a system automatically set up the odds. By calculating odds automatically, new wagering individuals may get a sense that their bets have a neutral expected value rather than a negative expected value, such as when wagers are made against a casino.

In some of the various embodiments, it is disclosed that one or more processors coupled to a memory is operable to read instructions from the memory to perform the steps of receiving a signal from a first device; based on the signal, sending a first code and an instruction to broadcast the code to a broadcasting device; receiving, from a second user device, an access request and a second code broadcasted from the broadcasting device; and granting the second user device access to a feature of an application when the second code broadcasted from the broadcasting device matches the first code.

In some of the embodiments, a wager system is disclosed, wherein the wagering system includes a wagering configuration module that receives a wager configuration from a first user device, sends a first code and an instruction to broadcast the code to a broadcasting device, receive a wager to the wager configuration and a second code broadcasted from the broadcasting device from a second user device, places the wager to the wager configuration when the second code broadcasted from the broadcasting devices matches the first code. The wagering system including a storage module that records the wager to the wager configuration when the wager configuration module places the wager to the wager configuration.

In some embodiments, it is disclosed that a system comprising a broadcasting device and a server including one or more processors coupled to a memory. The server may be operable to read instructions from the memory to perform the steps of receiving an instruction from a first device; based on the instruction, causing the broadcasting device to broadcast a first code; receiving, from a second user device, an access request and a second code broadcasted from the broadcasting device; and granting the second user device access to a feature of an application when the second code broadcasted from the broadcasting device matches the first code.

In some of the various embodiments several methods are disclosed, some of the methods may facilitate a wager and comprise receiving, by a system a configuration for a wager from a first user device and sending, by the system, a signal to a broadcasting device to broadcast a configuration for a second device which allows the second device to indicate acceptance of the wager to the system.

While the various examples disclosed herein focus on particular aspects regarding a socially interactive wagering system, it will be understood that the various inventive principles and embodiments disclosed herein may be applied to other types of applications and arrangements as well. For example, the access restriction system and methods that may be used by the socially interactive wagering system disclosed herein may be utilized in other applications unrelated to event wagering.

Reference throughout the specification to "various embodiments," "some embodiments," "one embodiment," "an embodiment," "various examples," "one example," "an example," or "some examples" means that a particular feature, structure, or characteristic described in connection with the embodiment or example is included in at least one embodiment. Thus, appearances of these are not necessarily all referring to the same embodiment. Furthermore, the particular features, structures or characteristics may be combined in any suitable manner in one or more embodiments.

According to some embodiments, a computer program product may comprise a non-transitory machine readable medium. The non-transitory machine readable medium may have computer readable and executable code for instructing one or more processors to perform any of the methods disclosed herein.

FIG. 1 illustrates, in block diagram format, an example embodiment of a computing system adapted for implementing socially interactive wagering. As shown, a computing system 100 may comprise or implement a plurality of servers and/or software components that operate to perform various methodologies in accordance with the described embodiments. Example servers may include, for example, stand-alone and enterprise-class servers operating a server OS such as a MICROSOFT® OS, a UNIX® OS, a LINUX® OS, or other suitable server-based OS. It may be appreciated that the servers illustrated in FIG. 1 may be deployed in other ways and that the operations performed and/or the services provided by such servers may be combined or separated for a given implementation and may be performed by a greater number or fewer number of servers. One or more servers may be operated and/or maintained by the same or different entities.

Computing system 100 may include, among various devices, servers, databases and other elements, a client 102 that may comprise or employ one or more client devices 104, such as a laptop, a mobile computing device, a PC, a wearable device, and/or any other computing device having computing and/or communications capabilities in accordance with the described embodiments. Client devices 104 may include a cellular telephone or other similar mobile device that a user may carry on or about his or her person and access readily.

Client devices 104 generally may provide one or more client programs 106, such as system programs and application programs to perform various computing and/or communications operations. Example system programs may include, without limitation, an operating system (e.g., MICROSOFT® OS, UNIX® OS, LINUX® OS, Symbian OS™, Embedix OS, Binary Run-time Environment for Wireless (BREW) OS, JavaOS, a Wireless Application Protocol (WAP) OS, and others), device drivers, programming tools, utility programs, software libraries, application programming interfaces (APIs), and so forth. Example application programs may include, without limitation, a web browser application, messaging applications (e.g., e-mail, IM, SMS, MMS, telephone, voicemail, VoIP, video messaging), contacts application, calendar application, electronic document application, database application, media application (e.g., music, video, television), location-based services (LBS) application (e.g., GPS, mapping, directions, point-of-interest, locator), and so forth. One or more of client programs 106 may display various graphical user interfaces (GUIs) to present information to and/or receive information from one or more of client devices 104.

As shown, client 102 may be communicatively coupled via one or more networks 108 to a network-based system 110. Network-based system 110 may be structured, arranged, and/or configured to allow client 102 to establish one or more communications sessions with network-based system 110 using various client devices 104 and/or client programs 106. Accordingly, a communications session between client 102 and network-based system 110 may involve the unidirectional and/or bidirectional exchange of information and may occur over one or more types of networks 108 depending on the mode of communication. While the embodiment of FIG. 1 illustrates a computing system 100 deployed in a client-server operating environment, it is to be understood that other suitable operating environments and/or architectures may be used in accordance with the described embodiments.

Data and/or audio communications between client 102 and the network-based system 110 may be sent and received over one or more networks 108 such as the Internet, a WAN, a WWAN, a WLAN, a mobile telephone network, a landline telephone network, as well as other suitable networks. For example, client 102 may communicate with network-based system 110 over the Internet or other suitable WAN by sending and or receiving information via interaction with a web site, e-mail, IM session, and/or video messaging session. Any of a wide variety of suitable communication types between client 102 and network-based system 110 may take place, as will be readily appreciated. In particular, wireless communications of any suitable form may take place between client 102 and network-based system 110, such as that which often occurs in the case of mobile phones or other personal and/or mobile devices.

In various embodiments, computing system 100 may include, among other elements, a third party 112, which may comprise or employ a third-party server 114 hosting a third-party application 116. In various implementations, third-party server 114 and/or third-party application 116 may host a web site associated with or employed by a third party 112. For example, third-party server 114 and/or third-party application 116 may enable network-based system 110 to provide client 102 with additional services and/or information, such as additional ticket inventory, event statistics, event schedules, social media connections, proof of identification, and/or other services. Third-party server 114 and/or third-party application 116 may provide network-based system 110 and/or client 102 with email services and/or information, social networking services and/or information, travel services and/or information, purchase services and/or information, or other online services and/or information.

In one embodiment, third-party server 114 may include a social networking server that hosts a user's social network account. In another embodiment, third-party server 114 may include an email server that hosts a user's email account. In yet another embodiment, third-party server 114 may include an event statistics server that provides information and data related to one or more events, such as a sporting event. In some embodiments, one or more of client programs 106 may be used to access network-based system 110 via third party 112. For example, client 102 may use a web client to access and/or receive content from network-based system 110 after initially communicating with a website of third party 112.

Network-based system 110 may comprise one or more communications servers 120 to provide suitable interfaces that enable communication using various modes of communication and/or via one or more networks 108. Communications servers 120 may include a web server 122, an API server 124, and/or a messaging server 126 to provide interfaces to one or more application servers 130. Application servers 130 of network-based system 110 may be structured, arranged, and/or configured to provide various online services, such as messaging, social networking, authentication, gambling, gaming, locating and other services to users that access network-based system 110. In various embodiments, client 102 may communicate with applications servers 130 of network-based system 110 via one or more of a web interface provided by web server 122, a programmatic interface provided by API server 124, and/or a messaging interface provided by messaging server 126. It may be appreciated that web server 122, API server 124, and messaging server 126 may be structured, arranged, and/or configured to communicate with various types of client devices 104 and/or client programs 106 and may interoperate with each other in some implementations.

Web server 122 may be arranged to communicate with web clients and/or applications such as a web browser, web browser toolbar, desktop widget, mobile widget, web-based application, web-based interpreter, virtual machine, and so forth. API server 124 may be arranged to communicate with various client programs 106 and/or a third-party application 116 comprising an implementation of API for network-based system 110. Messaging server 126 may be arranged to communicate with various messaging clients and/or applications such as e-mail, IM, SMS, MMS, telephone, VoIP, video messaging, and so forth, and messaging server 126 may provide a messaging interface to enable access by client 102 and/or third party 112 to the various services and functions provided by application servers 130.

When configured to implement a wagering service, application servers 130 of network-based system 110 may be a server that provides various online gambling, gaming, wagering, communications and social connection services. Application server 130 of network-based system 110 may provide services such as, account services, listing catalog services, dynamic content management services, payment services, gathering services, exchange services, swapping services, buying services, selling services, delivery services, location services, notification services, fund transfer, funds and/or currency exchanges and/or other services. Application servers 130 may include an account server 132, a listing catalog server 138, a dynamic content management server 140, a payment server 142, a notification server 144, and/or a delivery server 146 structured and arranged to provide services as discussed above and in more detail below.

Application servers 130 may further be implemented as an online ticket marketplace that provides various online marketplace and ticket fulfillment services further including, for example, buying services, selling services, delivery services, and payment services. Application servers 130 may further include a selling server 134, a buying server 136, a payment server 142, and/or a delivery server 146 structured and arranged to provide such online marketplace, online wagering, and/or ticket fulfillment services.

Application servers 130, in turn, may be coupled to and capable of accessing one or more databases 150 including a subscriber database 152, an active events database 154, and/or a transaction database 156. Databases 150 generally may store and maintain various types of information for use by application servers 130 and may comprise or be implemented by various types of computer storage devices (e.g., servers, memory) and/or database structures (e.g., relational, object-oriented, hierarchical, dimensional, network) in accordance with the described embodiments.

Figure 2:
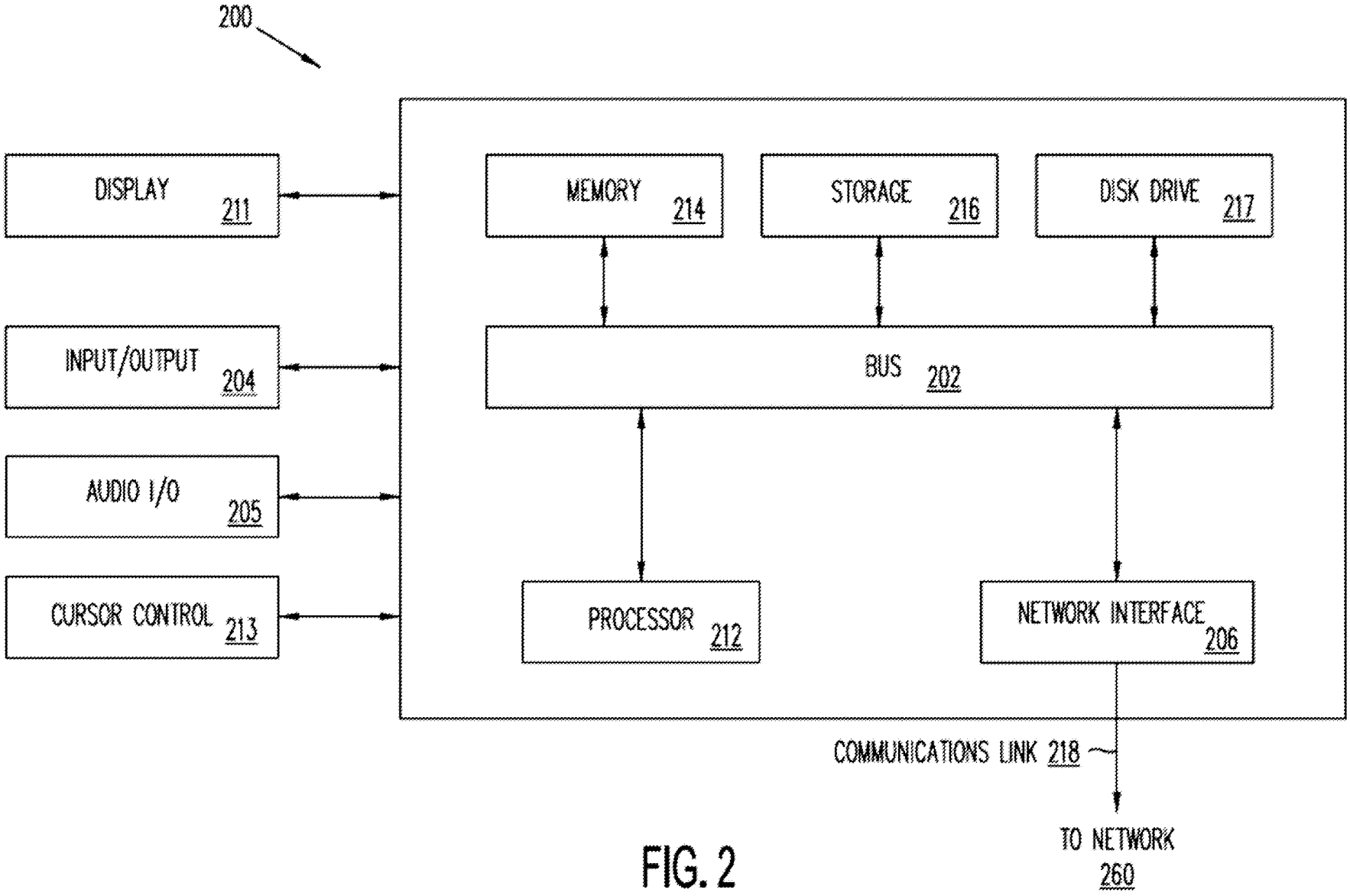
FIG. 2 is a block diagram of an example computer system suitable for implementing one or more devices of the computing system in FIG. 1.

FIG. 2 illustrates an example computer system 200 in block diagram format suitable for implementing on one or more devices of the computing system in FIG. 1. In various implementations, a device that includes computer system 200 may comprise a personal computing device (e.g., a smart or mobile phone, a computing tablet, a personal computer, laptop, wearable device, PDA, Bluetooth device, key FOB, badge, etc.) that is capable of communicating with a network. A service provider and/or a payment provider may utilize a network computing device (e.g., a network server) capable of communicating with the network. It should be appreciated that each of the devices utilized by users, service providers, and payment providers may be implemented as computer system 200 in a manner as follows.

Additionally, as more and more devices become communication capable, such as sensors using wireless communication to report, track, message, relay information and so forth, these devices may be part of such transactions. For example, a user may have a jacket with a sensor or communication device embedded in the jacket and the jacket may double as a broadcasting device that may be used to link to other devices of other individuals who may be potential wager participants. In some embodiments, the potential participants may depend on proximity between devices. In some examples, a first user's jacket may be a part of or establish a mesh network with devices within its area and delineate an exclusive group of individuals who may create wagers with each other on a wagering system, such as a system or method to provide some or all of the services discussed below.

Computer system 200 may include a bus 202 or other communication mechanisms for communicating information data, signals, and information between various components of computer system 200. Components include an input/output (I/O) component 204 that processes a user action, such as selecting keys from a keypad/keyboard, selecting one or more buttons, links, actuatable elements, etc., and sends a corresponding signal to bus 202. I/O component 204 may also include an output component, such as a display 211 and a cursor control 213 (such as a keyboard, keypad, mouse, touch screen, etc.). An optional audio input/output component 205 may also be included to allow a user to use voice for inputting information by converting audio signals. Audio I/O component 205 may allow the user to hear audio. A transceiver or network interface 206 transmits and receives signals between computer system 200 and other devices, such as another user device, a merchant server, a venue server, an email server, a gaming server, a wagering server, application service provider, web server, a social networking server, an event statistics server, other third-party servers, a payment provider server, and/or other servers via a network. In various embodiments, such as for many cellular telephone and other mobile device embodiments, this transmission may be wireless, although other transmission mediums and methods may also be suitable. A processor 212, which may be a microcontroller, digital signal processor (DSP), or other processing component, processes these various signals, such as for display on computer system 200 or transmission to other devices over a network 260 via a communication link 218. Again, communication link 218 may be a wireless communication in some embodiments. Processor 212 may also control transmission of information, such as cookies, IP addresses, and/or the like to other devices.

Components of computer system 200 also include a system memory component 214 (e.g., RAM), a static storage component 216 (e.g., ROM), and/or a disk drive 217. Computer system 200 performs specific operations by processor 212 and other components by executing one or more sequences of instructions contained in system memory component 214. Logic may be encoded in a computer readable medium, which may refer to any medium that participates in providing instructions to processor 212 for execution. Such a medium may take many forms, including but not limited to, non-volatile media, volatile media, and transmission media. In various implementations, non-volatile media includes optical or magnetic disks, volatile media includes dynamic memory, such as system memory component 214, and transmission media includes coaxial cables, copper wire, and fiber optics, including wires that comprise bus 202. In one embodiment, the logic is encoded in a non-transitory machine-readable medium. In one example, transmission media may take the form of acoustic or light waves, such as those generated during radio wave, optical, and infrared data communications.

Some common forms of computer readable media include, for example, floppy disk, flexible disk, hard disk, magnetic tape, any other magnetic medium, CD-ROM, any other optical medium, punch cards, paper tape, any other physical medium with patterns of holes, RAM, PROM, EPROM, FLASH-EPROM, any other memory chip or cartridge, or any other medium from which a computer is adapted to read.

In various embodiments of the present disclosure, execution of instruction sequences to practice the present disclosure may be performed by computer system 200. In various other embodiments of the present disclosure, a plurality of computer systems 200 coupled by communication link 218 to the network (e.g., such as a LAN, WLAN, PTSN, and/or various other wired or wireless networks, including telecommunications, mobile, and cellular phone networks) may perform instruction sequences to practice the present disclosure in coordination with one another. Modules described herein may be embodied in one or more computer readable media or be in communication with one or more processors to execute or process the steps described herein A computer system may transmit and receive messages, data, information and instructions, including one or more programs (i.e., application code) through a communication link and a communication interface. Received program code may be executed by a processor as received and/or stored in a disk drive component or some other non-volatile storage component for execution.

Where applicable, various embodiments provided by the present disclosure may be implemented using hardware, software, or combinations of hardware and software. Also, where applicable, the various hardware components and/or software components set forth herein may be combined into composite components comprising software, hardware, and/or both without departing from the spirit of the present disclosure. Where applicable, the various hardware components and/or software components set forth herein may be separated into sub-components comprising software, hardware, or both without departing from the scope of the present disclosure. In addition, where applicable, it is contemplated that software components may be implemented as hardware components and vice-versa.

Software, in accordance with the present disclosure, such as program code and/or data, may be stored on one or more computer readable media. It is also contemplated that software identified herein may be implemented using one or more computers and/or computer systems, networked and/or otherwise. Such software may be stored and/or used at one or more locations along or throughout the system, at client 102, network-based system 110, or both. Where applicable, the ordering of various steps described herein may be changed, combined into composite steps, and/or separated into sub-steps to provide features described herein.

The foregoing networks, systems, devices, and numerous variations thereof may be used to implement one or more services, such as a socially interactive wagering service.

Figure 3:
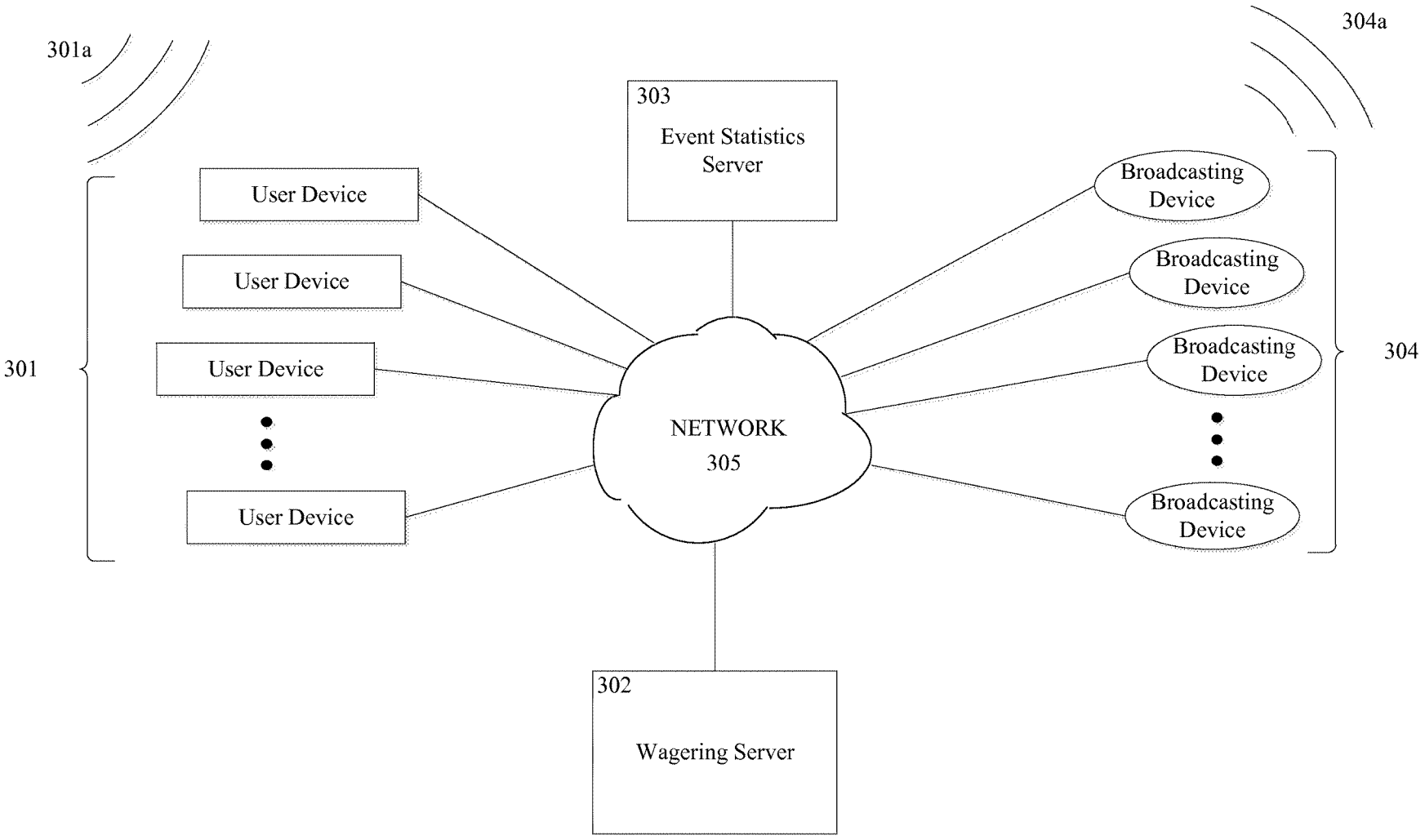
FIG. 3 is a block diagram of an example socially interactive wagering system.

FIG. 3 illustrates, in block diagram format, an example embodiment of a system adapted for a socially interactive wagering system 300. Wagering system 300 may include one or more user devices 301 with the ability to send and/or receive broadcast signals 301*a*, a wagering server 302, an event statistics server 303, and one or more broadcasting devices 304 with the ability to send and/or receive broadcast signals 304*b*. In some embodiments one or more user devices 301, wagering server 302, event statistics server 303 and one or more broadcasting devices 304 communicatively coupled over one or more networks 305. In some embodiments, the broadcast signals represented by 301*a* and 304*a* may be communications between one or more user devices 301 and one or more broadcasting devices 304.

A user may use a device such as user device 301 to create and/or place wagers through wagering system 300 for an event. User device 301 may be a mobile device such as a cellular telephone, a tablet computer, a laptop computer, wearable device, or another portable computing device. User device 301 may be a non-mobile device such as a home (land line) telephone, a desktop computer, an interactive set top box, or the like. User device 301 may be any device or combination of devices with I/O components for interacting with an application executed on the device for communicating with a server over a network. In some embodiments the application may be a web browser or a proprietary software application. User device 301 may also be capable of communicating with multiple networks including but not limited to telephone networks, personal area networks, wide area networks, local area networks, the internet and the like. In some embodiments, user device 301 may have a communication mode in which user device 301 can broadcast and/or receive broadcasted signals 301*a*. Broadcast signals 301*a* may be an electromagnetic wave including radio, infrared, and other frequencies used for wireless communications. In some embodiments, broadcast signals 301*a* may be a signal using a wired connection, optical information from a display, audio signal, and/or other signals used for communications. User devices 301 may, for example, be an implementation of client device 104 of FIG. 1.

Wagering server 302 may comprise servers and/or databases to provide suitable interfaces that enable devices to communicate and/or exchange data with wagering server 302 using various modes of communication and/or via one or more networks 305. In some embodiments, user devices 301, event statistics server 303, and one or more broadcasting devices 304 may communicate with the one or more servers of wagering server 302 through network 305 via one or more web interfaces, one or more programmatic interfaces, and/or one or more messaging interfaces provided by the one or more servers of wagering server 302. In some embodiments wagering server 302 may be operated by an online ticket seller such as StubHub, Inc. Wagering server 302 may facilitate communications and event wagers between users in addition to online ticket sales and/or online ticket exchanges. Wagering server 302 may include one or more servers located at one or more locations. Thus, the wagering server 302 may be geographically and operationally distributed if desired. Wagering server 302 may be part of another system, such as a payment provider system. Wagering server 302 may, for example, be a part of and/or an implementation of network-based system 110 of FIG. 1.

In some embodiments, wagering server 302 may enable users to create and accept wagers associated with and/or related to an event, such as an event a user is viewing, attending the event at the event venue and/or a venue display the event, and/or otherwise participating. In some embodiments, wagering server 302 may provide a service which allows users to create wagers based competitions and tournaments. Wagering server 302 may handle other logistics for handling wagers which may include, but are not limited to, wager settlements, connections to individuals, broadcasting wagers, authentication services, payment services, calculations for betting odds, currency exchange, facilitating the configurations of wagers, providing a GUI, and/or other services.

Event statistics server 303 may be a server with a database of event statistics. In some embodiments, wagering server 302 and/or user devices 301 may communicate with event statistics server 303 using one or more APIs over network 305. In some embodiments, event statistics server 303 may communicate event statistics, updates, and/or other event information to wagering server 302 and/or user devices 301. Event statistics server 303 may send statistics and/or actions to wagering server 302 and/or user devices 301 as they happen in real time. In some embodiments, wagering server 302 may use one or more event statistics to settle wagers between users. In some embodiments wagering server 302 may relay information it receives from event statistics server 303 to one or more user devices 301 for display. Event statistics server 303 may be a part of a third party sports statistics provider such as Stats Pass®, ESPN® and/or other third-party event statistics providers.

In some embodiments, broadcasting devices 304 may be a single form communications device meant for publicly relaying and/or broadcasting information and/or data from wagering server 302 to one or more user devices 301. In some embodiments, broadcasting device 304 may contain a communications system configured to communicate with wagering server 302 over one or more networks 305 such as the Internet, a WAN, a WWAN, a WLAN, a mobile telephone network, a landline telephone network, as well as other suitable networks. In some embodiments, the communications system may also be configured to communicate and/or publicly broadcast information and/or data to one or more user devices 301 through signal 304*a*. Signal 304*a* may be communicated and/or received through one or more wired or wireless connections of one or more user devices 301.

In some embodiments, broadcasting device 304 may be a device for transferring data, such as a USB device or an RFID. In some embodiments, the data on broadcasting device 304 may be remotely updated, erased, written, and/or edited, for example, through a wired and/or wireless connection and/or a RFID read/write device that is connected to wagering server 302 through one or more networks 305. In some embodiments, the data on broadcasting device 304 may be remotely updated, erased, written, and/or edited by an intermediary device which was provided with the data by wagering server 302.

In some embodiments, broadcasting device 304 may be a device that is configured to display a QR code, a bar code, and/or other machine readable optical labels. The display on the device may be updated or refreshed such that the machine readable optical labels are changeable. In some embodiments, the display on the device may be remotely updated or refreshed by wagering server 302 through one or more connections to networks 305.

In some embodiments, broadcasting device 304 may be a multimode communications device meant for publicly relaying and/or broadcasting information and/or data from wagering server 302 to one or more user devices 301. Broadcasting device 304 may have one or more communications system for broadcasting data or information. In some embodiments, broadcasting device 304 may contain a communications system configured to communicate with wagering server 302 over one or more networks 305 such as the Internet, a WAN, a WWAN, a WLAN, a mobile telephone network, a landline telephone network, as well as other suitable networks. In some embodiments broadcasting device 304 may contain one or more additional communications systems for broadcasting data with signal 304*a*. The one or more additional communications systems may be configured to communicate and/or broadcast signal 304*a* over one or more networks such as personal area networks using wireless technology such as Bluetooth®, Bluetooth® low energy, wireless infrared communications, wireless USB, or other wireless technologies for exchanging data over short distances. In some embodiments, broadcasting device 304 may be configured to broadcast signal 304*a* to a certain area. The area in which signal 304*a* covers may be configured by changing the broadcasting power of broadcasting device 304 and/or other methods of restricting signal coverage.

In some embodiments, one or more user devices 301 may double as a broadcasting device 304 and may create a mesh network between all devices within a limited area, such as within a stadium or an entertainment location/venue. This in turn may delineate one or more social groups for wagering server 400 to provide activities for individuals that are part of the social group and/or groups. Activities such as chatting, wagering, gaming, meeting, messaging, and any other activity.

Figure 4:
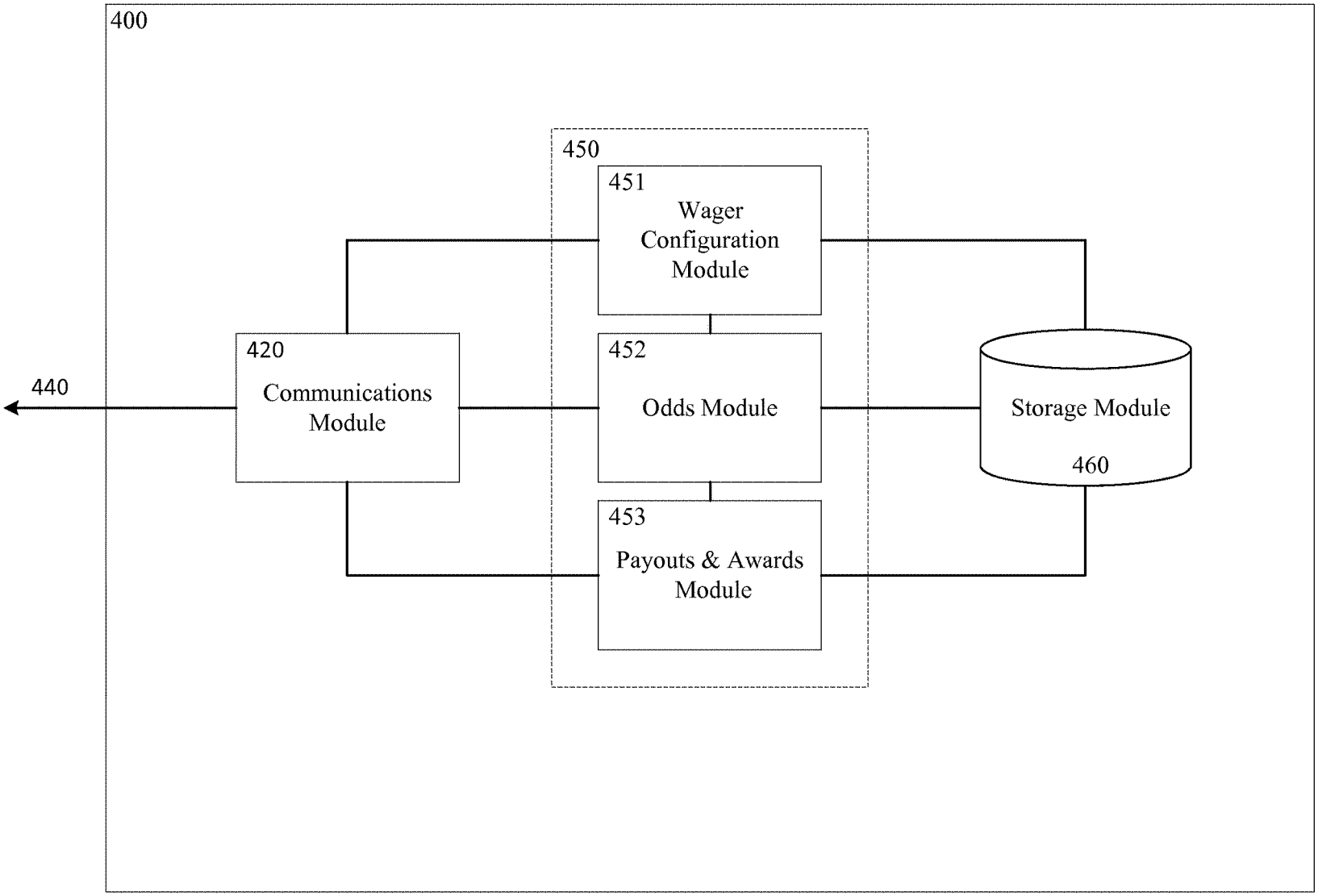
FIG. 4 is a block diagram of an example wagering server of FIG. 3.

FIG. 4 illustrates an example embodiment of a wagering server 400. In some embodiments, wagering server 400 may be the wagering server 302 discussed in FIG. 3. In some embodiments, wagering server 400 may be a part of and/or an implementation of network-based system 110 of FIG. 1. The wagering server 400 may include a communication module 420 that is coupled to a network 440 which may be a LAN, the internet, or any other network. In some embodiments, network 440 may be the one or more networks 305 discussed in FIG. 3. The communication module 420 may include software or instructions stored on a computer-readable medium that allows wagering server 400 to send and receive information over the network 440. Communication module 420 may be an implementation of a number of servers which may include but are not limited web servers, such as web server 122 of FIG. 1; API servers such as API server 124 of FIG. 1; messaging servers, such as messaging server 126 of FIG. 1; and/or the like.

Communication module 420 may be coupled to wagering module 450 which may include wager configuration module 451, odds module 452, and/or payouts and awards module 453. In some embodiments, wagering module 450 may be coupled to a storage module 460, such as database 150 of FIG. 1.

Wagering module 450 may include software or instructions stored on a computer-readable medium that is configured to record and facilitate wagers between individuals. Although the different functions that wagering module 450 may perform are categorized and separated as wager configuration module 451, odds module 452, and/or payouts and awards module 453, one of ordinary skill in the art will recognize that wagering module 450 may include a singular instruction set stored on a computer readable medium. Additionally, one of ordinary skill in the art would recognize a wide variety of ways in which the functions of wagering module 450 may be categorized and separated and thus fall within the scope of the disclosure.

In some embodiments wager configuration module 451 may include software or instructions stored on a computer readable medium that may be configured to send or receive instructions and/or communications to and/or from client devices, such as user device 301 of FIG. 3 and/or client device 104 of FIG. 1; event statistics providers, such as event statistics server 303 of FIG. 3; and/or broadcasting devices, such as broadcasting devices 304 described in FIG. 3. Wager configuration module 451 may be configured to receive wager configurations from user devices, broadcast wagers, broadcast instructions and/or other data to broadcasting devices, receive wagers from user devices, broadcast access rights, receive event statistics, create social groups among users with devices that received broadcasts from a broadcasting device, and/or maintain records of wagers and/or event statistics, and other configurations discussed in more detail below. In some embodiments, wager configuration module 451 may communicate with third party servers such as ones employed by a social networking website, email service provider, and the like to aid in some of the functionality of wager configuration module 451. For example, a wager configuration received from a user device may include instructions to exclude individuals and/or devices from placing a wager who are not on a contacts list of a social networking website. The contacts lists may be available from one or more servers employed by one or more social networking websites, email servers, and/or third parties in communications with wager module 450. Wager configuration module 451 may use information received from one or more of these third-party servers in excluding or providing access to certain wagers and/or the ability to place a wager.

In some embodiments, wager configuration module 451 may receive a wager configuration from a user device which includes instructions and/or access restrictions to exclude and/or limit individuals and/or devices that are or are not in a particular seating area, venue, arena, or other locations from submitting and/or accepting wagers. In some embodiments, wager configuration module 451, to comply with the instruction, may determine seating information for a user account from a server run by a ticket exchange service, such as StubHub, Inc., and restrict wagers to accounts that bought tickets from the ticket exchange service with seats within the seating area restriction. In some embodiments, a business, such as StubHub, Inc., may configure wager configuration module 451 such that it accepts wagers from individuals who purchased tickets from the business. In this manner, an additional user experience that does not exist with a competitor may be provided. This, in turn may aid in increasing brand loyalty.

In some embodiments, wager configuration module 451 may allow a user to create contests and/or tournaments. For example, in some embodiments, wager configuration module 451 may allow users to create brackets, such as a March madness bracket for college basketball. Users may be able to set an entry fee and set prizes based on the entry fee. In some embodiments, user may create a fantasy football league with prizes for the users with the highest scores. In some embodiments, wager configuration module 451 may allow users to create and configure a competition with self-sponsored prizes.

One example competition may be set up such that every player within a group is set up with an equal amount of virtual currency. Virtual currency may include commodities, fake currencies, points, such as StubHub points, bitcoins, real currency, and/or anything else that can be used as a wager. Participants may make wagers with each other using the virtual currency with the goal of amassing additional units of the currency through wagering. Prizes may be set up for one or more of the participants who were able to gather the most units of the virtual currency. In some embodiments, social groups may be created that only allow participation by the group members. The social groups may be delineated by factors such as, whether tickets where bought through a particular ticketing seller, seated in a certain section of an event location, attending an event live, and/or the like.

In some embodiments, wager configuration module 451 may set up a messaging system for wagering individuals to interact and/or negotiate additional wagers. In some embodiments, wager configuration module 451 may receive location information of one or more user devices and send the location information to other user devices. In some embodiments, the location information may be a GPS location from a user device, or seating information from a ticket purchased through a related ticketing agent. Because individuals participating in a wager may be uncomfortable with meeting up with strangers, wager configuration module 451 may provide location information when the location information is at an event venue during an event. Event venues generally have tight security which may provide a sense a safety to participants in a wager. In some embodiments, wagering configuration module may make location information of every participant within an arena available to the participants. In some embodiments users may be able to instruct wager configuration module to share or not share location information with other users. In some embodiments, a user name and the ability to send instant messages between the participants may also be provided along with the location information. In this manner, participants may identify each other and initiate in-person contact.

Wager configuration module 451 may create, display, control, and/or interact with a GUI that may be displayed on a user device. In some embodiments, the user interface may be a web interface hosted by a web server. In some embodiments, the user interface may be displayed by proprietary software installed and/or held on a user device. The proprietary software may interact with wager configuration module 451 through appropriate APIs. In some embodiments, the GUI may provide one or more inputs, outputs, and/or actuatable elements which may allow a user to sort and find wagers, such as sorting by wager values, friends, venue, seating area, most popular, biggest betting pool, and/or other sorting criteria. In some embodiments, the GUI may have several input, output, and/or actuatable elements for configuring a wager, as discussed in more detail below.

Referring to odds module 452, in some embodiments, odds module 452 may be software or instructions stored on a computer readable medium that may be configured to calculate betting and/or wagering odds based on the number of wagers, prize pool, and the like. Odds module 452 may run one or more automated algorithms to calculate betting odds for a particular wager configuration.

Payouts and awards module 453 may include software and/or instructions stored on a computer readable medium that may be configured to settle bets and/or wagers between one or more individuals after a triggering event. Triggering events (also referred to as a settlement trigger) may depend on a wager configuration and may be triggered by one or more event statistics. Payout and awards module 453 may receive event statistics from a third-party such as a sports statistics provider like Stats Pass®, ESPN®, and/or the like. One or more game, player, and/or team statistics may be used as part of a triggering event. An event statistic may include, but is not limited to, scores in a sporting event, the statistics of a player and/or team in a sporting event, whether a team and/or player for a sporting event wins or loses, whether a sporting event goes into overtime, and/or the like. In some embodiments, event statistics may include how a sports team and/or player performs in a series of games. This may include, but is not limited to, whether a team and/or player makes it into the playoffs, quarter finals, semi-finals, championship, and the like. For example, a wager may be configured such that player 22 has to score 20 points within the first half of a game. In this example, player 22 scoring 20 points or the end of the first half may be the triggering events for the wager.

Settling a bet may include the transfer of monetary funds, virtual points, virtual currency, publication of the winner and/or loser on a social media website, assigning a prize, and/or the like. In some embodiments, users may agree to settle wagers in person. There may be an actuatable element (e.g., a check box) displayed on a user device, when actuated, that requests in-person settlement. In some embodiments, a user may accept or decline the request for in-person settlement through one or more actuatable elements displayed as part of a GUI on a user device. When users agree to use in-person settlement to settle a bet, payouts and awards module 453 may receive or retrieve location information, such as a GPS location, seat number, section number, and/or other location information from the user's devices, third-party servers, or other devices in communication with wager module 450. In some embodiments, payouts and awards module 453 may send the received/retrieved location information to one or more user devices for wagering parties to meet in person. Because participants may be more inclined to in-person meetings in a safe location, the location services feature may be unlocked when wager module 450 determines that the devices are at a public arena or event. In some embodiments, payouts and awards module 453 may open a chat session on one or more user devices for enabling users to chat with each other. In some embodiments, an audio and/or video chat session may be opened.

Wagering server 400 may also include storage module 460. In some embodiments, storage module 460 may be a part of database 150 of FIG. 1. Storage module 460 may keep track of wagers, wager configurations, players/accounts, player/account rankings, and/or any other wagering information. While storage module 460 have been illustrated as located in the wagering server 400, one of skill in the art will recognize that it may be connected to the wagering module 450 through network 440 without departing from the scope of the present disclosure. Thus, the storage module 460 may be geographically and operationally distributed if desired.

Figure 5:
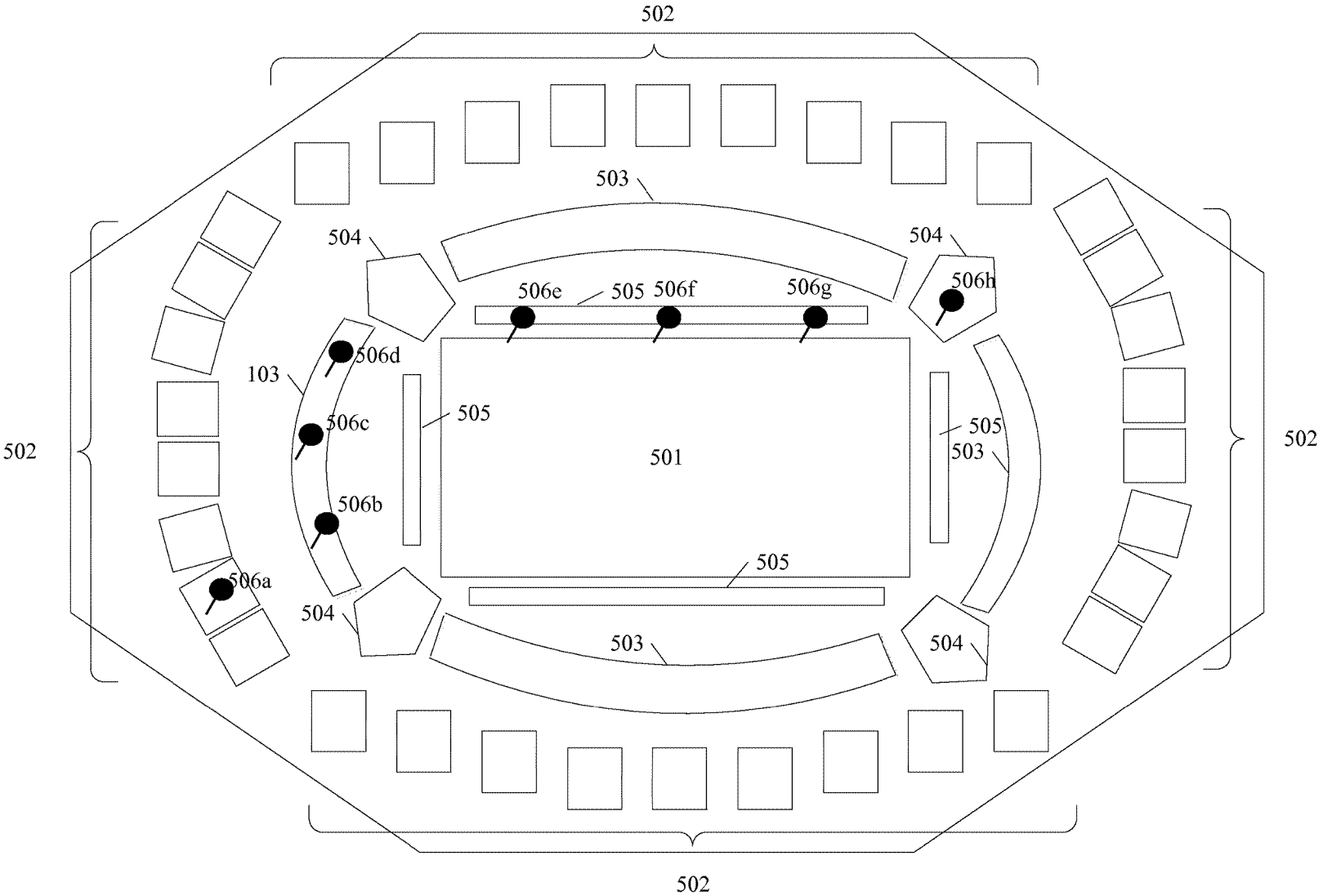
FIG. 5 is an example floor plan of an event venue implementing broadcasting devices of FIG. 2.

FIG. 5 illustrates an example floor plan of a physical entertainment location 500 that may be a venue for which individuals may attend for an event. An event may include, but is not limited to, sporting events, concerts, theatrical performances, conventions, and the like. In some examples, entertainment location 500 may be a sports arena which includes an arena 501 and one or more outer seating areas 502. In some embodiments, outer seating area 502 may be separated into different sections as represented by the separated boxes. Each section of outer seating area 502 may include one or more seats for patrons to sit and view the arena. Entertainment location 500 may also have one or more intermediate seating areas 503 which may include seats that are closer to arena 501 than the seats within one or more outer seating areas 502. Entertainment location 500 may also include one or more box suites 504. In some embodiments the box suites 504 may be a set of small private rooms that provide an opening and/or a window for viewing arena 501. The small rooms may be equipped with a seating area with several seats for viewing arena 501.

Entertainment location 500 may also include one or more lower level seating areas 505. Lower level seating areas 505 may include seats that are closer to arena 501 than intermediate seating area 503. Lower level seating area 505, because of its proximity to the arena, may generally include some of the more expensive seats. Depending on the seating area, seats may have different values. In some embodiments Entertainment location 500 may have one or more data broadcasting devices spread out in different areas of entertainment location 500, such as broadcasting devices 506*a-h*. Each of the broadcasting devices 506*a-h* may be a RFID tag, data transferring port such as a USB port, a Bluetooth beacon, a wireless switch and/or router, a display in which a QR code may be displayed, a RF transmitter, an IR transmitter, or any other data transferring device. One or more of broadcasting devices 506*a-h* may be the broadcasting device 304 of FIG. 3.

In some embodiments, one or more broadcasting devices 506*a-h* may relay data that originated from a wagering server, such as a server that includes the wagering module 450 of FIG. 4. In some embodiments, the data relayed by one or more broadcasting device 506*a-h* may be a code and/or a configuration for a user device that affects access levels or unlocks features of a website or application. In some examples, the ability to place or receive a wager through an application on a wager server, such as a server that includes the wagering module 450 of FIG. 4, may be unlocked.

In some embodiments, one or more broadcasting devices 506*a-h* may be a wireless transmitter configured for a limited range. In some embodiments, one or more broadcasting devices 506*a-h* may be configured to have a range that is limited and/or covers a certain seating area. In some examples, broadcasting device 506*a* may be configured to only transmit data to devices within a particular seating section, such as the seating section delineated by the box surrounding broadcasting device 506*a*. In some examples, one or more broadcasting devices, such as broadcasting devices 506*b-d*, may be configured to provide data transferring coverage of one or more sections in the intermediate seating areas 503. In some examples, one or more broadcasting devices may be placed in one or more box suites 504, such as transmitter 506*h*, to cover devices within the box suite. In some examples, there may be data transmitters placed in one or more locations in the lower level seating areas 505 to cover some or all of the devices within lower level seating area 505, such as data transmitter's 506*e-g*.

In some embodiments, there may be a data transmitter for each individual seat in entertainment location 500, such as a broadcasting device discussed in FIG. 3. In some embodiments, the data transmitter may be a wireless transmitter. In another embodiments, the data transmitter may be an RFID tag, a USB port, or a screen that may display a QR code.

In some embodiments, entertainment location 500 may have a data transmitter that covers and/or is limited to the entire area of entertainment location 500. In some cases this may be a giant television screen that may display a QR code. In some embodiments, a wireless transmitter configured to cover entertainment location 500 (not shown) may be used to transmit data to any device within or close to entertainment location 500.

Although entertainment location 500 depicted in FIG. 5 illustrates a floor plan for a stadium with a rectangular arena, and fixed seating areas, some embodiments may have different floor plans. Some example floor plans may include, but are not limited to, a semi-circular amphitheater with tiered seating facing a stage, a baseball stadium with seating arranged around the baseball field diamond, a parking lot behind a venue for events such as tail gating, and/or a convention center with large open areas which may be without fixed seating areas. One of ordinary skill in the art in possession of the present disclosure will recognize a wide variety of physical entertainment locations that will benefit from the teachings of the present disclosure and thus will fall within its scope.

Figure 6:
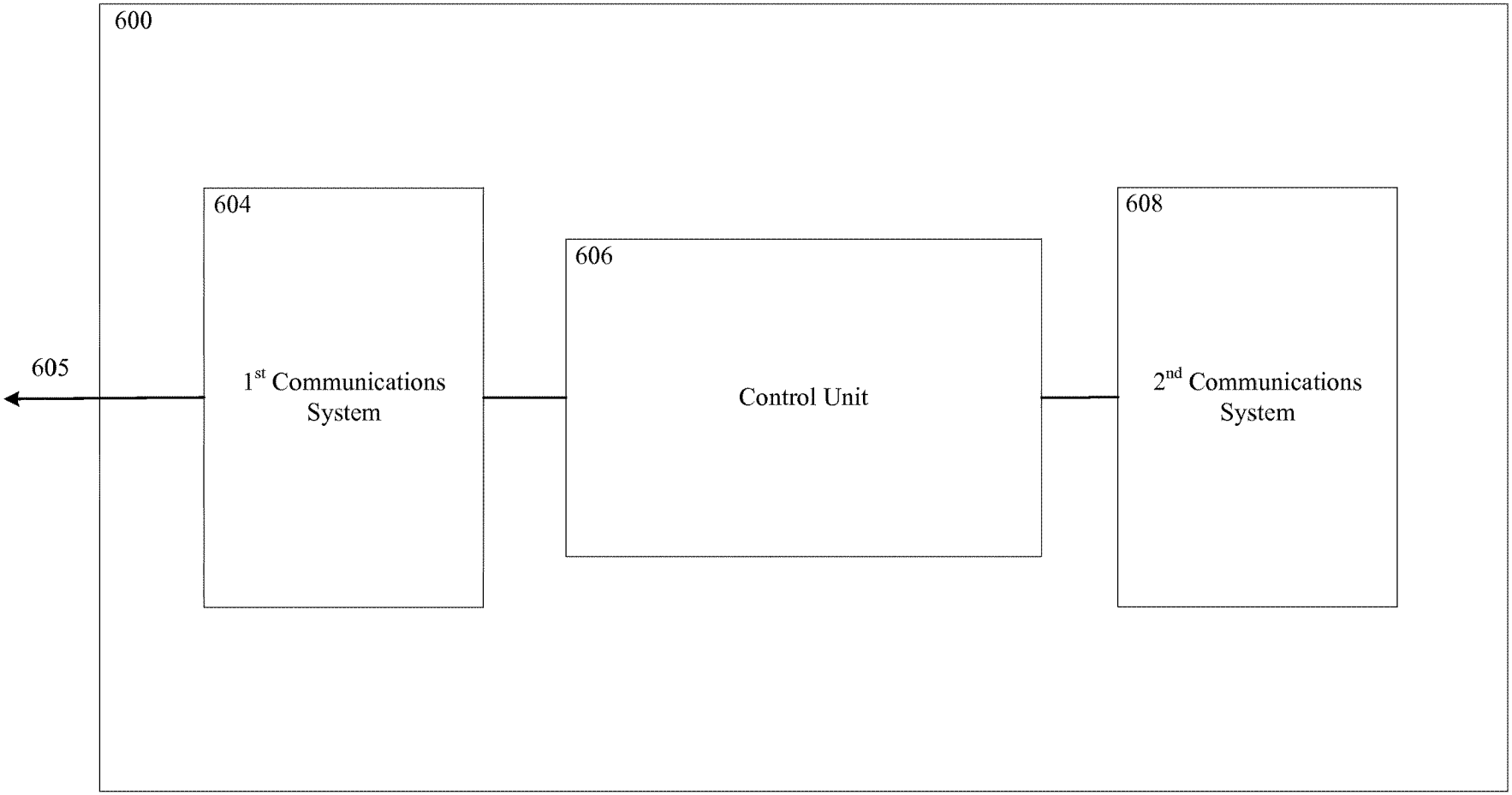
FIG. 6 is a block diagram of an example broadcasting device of FIG. 2.

Referring now to FIG. 6, an example embodiment of a broadcasting device 600 is illustrated. The broadcasting device 600 may include a first communications system 604 such as, for example, a WiFi communications system that may be connected to a network 605 such as a local area network (LAN), the internet, networks discussed in FIG. 1-5, and/or the like. The first communications system 604 may be coupled to a control unit 606 that may include instructions on a memory system (not illustrated) in the broadcasting device 600 that, when executed by a processing system (not illustrated) in broadcasting device 600, cause the processing system to perform the functions of the broadcasting device 600 discussed in this disclosure. The control unit 606 may be coupled to a second communication system 608 such as, for example, a Bluetooth® Low Energy (BLE) communication system. The control unit 606 may be configured to receive instructions from a system provider device, such as wagering server 302 of FIG. 3, through the network to broadcast data by second communication system 608. In some embodiments, broadcasting device 600 may be configured to broadcast data wirelessly such that one or more devices within broadcasting range of second communication system 608 may receive the broadcasts. In some embodiments, the data that second communication system 608 broadcasts may be a configuration, code, unique identifier and/or the like. Broadcasting device 600 may be configured to broadcast within a limited range by reducing the broadcasting power of the device. In some embodiments, the broadcasting range of broadcasting device 600 may be remotely controlled by a server, such as wagering server 302 discussed in FIG. 3 and/or other devices.

While a few examples of communications components in the broadcasting device 600 have been described, one of skill in the art will recognize that other communications devices, as well as other components that have been omitted for clarity of discussion, may be included in the broadcasting device 600 and will fall within the scope of the present disclosure. One of ordinary skill in the art will recognize that the components described above may allow for the communications device to be provided in a relatively small form factor such that it may be placed inconspicuously almost anywhere, such as underneath a seat. In some embodiments, broadcasting device 600 may be fixed to a location to act as a beacon. In some embodiments, broadcasting device 600 may be housed in a chassis and may include any of a variety of features that allow for the coupling of the broadcasting device to different areas in a physical location, such as the entertainment location 500 discussed in FIG. 5. In some embodiments, broadcasting device 600 may be a personal digital assistant (PDA) device, a smart phone or any other dual mode communications device.

Figure 7:
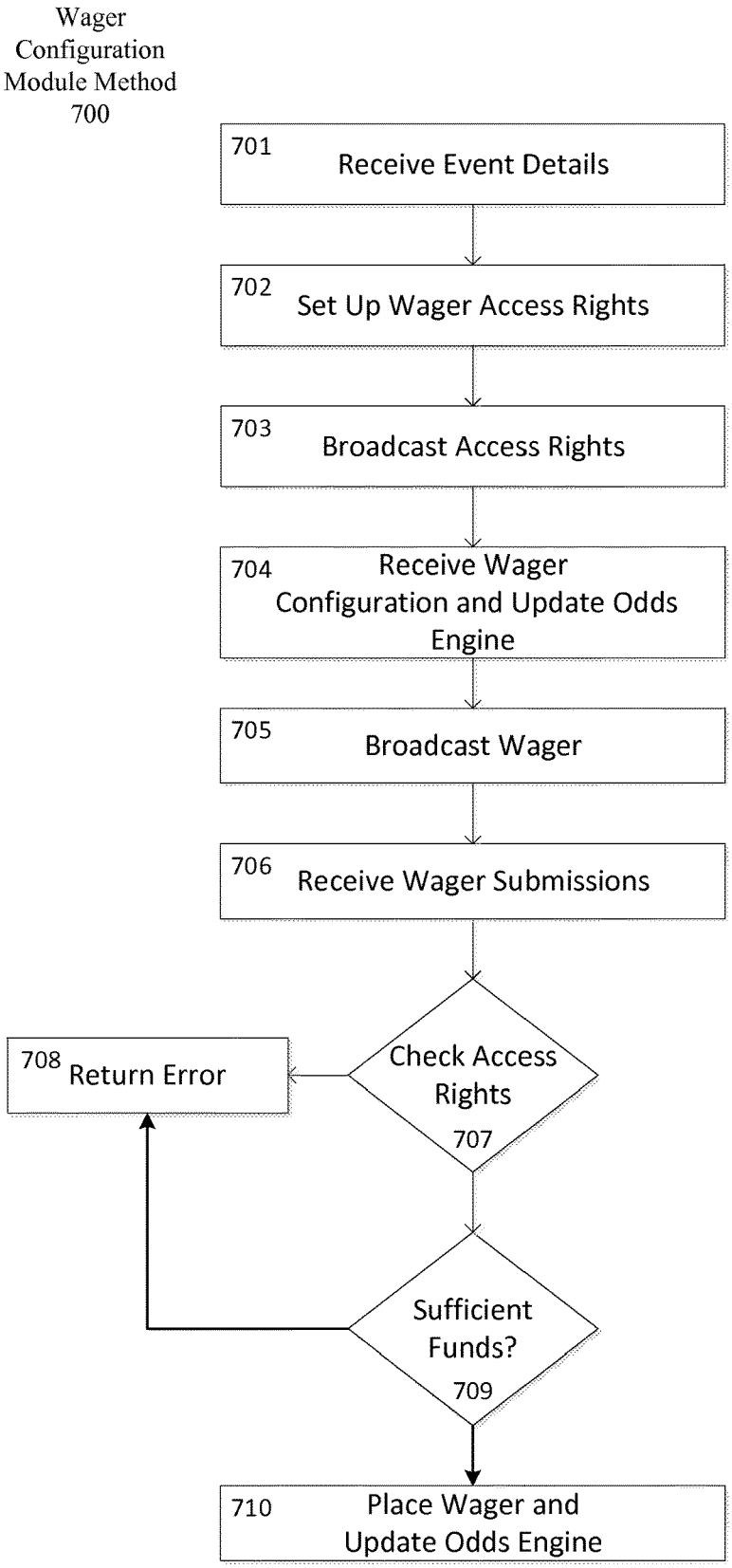
FIG. 7 is a flow chart of an example wager configuration method that may be implemented by the wager configuration module of FIG. 4.

FIG. 7 is a flow chart illustrating an embodiment of a method 700 that may be included in an implementation of a wager configuration module, such as wager configuration module 451 of FIG. 4. In some embodiments, one or more processes 701-710 of method 700 may be implemented, at least in part, in the form of executable code stored on non-transient, tangible, machine readable media that when run by one or more processors may cause the one or more processors to perform one or more of the processes 701-710.

At process 701, method 700 may receive one or more event details. This may include a date and time of an event, the type of event, teams and/or players in an event, event location, and/or other details of an event. In some embodiments, this may be a sporting event such as basketball, baseball, football, soccer, boxing, tennis, golf, or any other sporting event. Event details may be received through an API to a server which provides event details, retrieved from a database of events, and/or from entries from a user. In some embodiments, event details may be retrieved from a database for a ticket sales or exchange service provider, such as StubHub, Inc. In some embodiments, event details may be received or retrieved from a governing body for an event, such as the NFL®, NBA®, MLB®; stadiums or other hosting venues; and/or the like.

At process 702, method 700 may set up wager access rights for a particular event. Wager access rights may lock, limit, unlock, and/or release an account and/or a user's ability to create and/or place a wager through the wager configuration module. Additionally, process 702 create social groups for interactions such as creating chat groups, or the ability to meet individuals, and participate in other social activities based on the access rights. The access rights might limit which individuals may interact with each other. Process 702 may limit user access and/or create social groups based on one or more combination of factors such as whether the users are at an venue for the event, in a particular section and/or location of a venue, watching the event live, purchased tickets through a particular ticket sales or exchange service provider, within a certain age limit, and/or other limiting factors.

At process 703, method 700 may broadcast identification information (ID), codes, instructions, and/or configurations and/or provide codes for broadcast that may provide access rights or unlock features for a user device. In some embodiments, the codes, instructions, and or configurations may allow a user device to conduct wager submissions, indicate acceptance for a wager, create wagers, participate in a social group and/or the like. In some embodiments, the instruction broadcast may be instructions for broadcasting devices, such as broadcasting devices 304 of FIG. 3, to broadcast a code and/or configuration. The code broadcasts may be used to determine whether some of the factors discussed at process 702 are met and provide access to those devices. The code and/or configurations may be stored in a database, such as database 150 of FIG. 1 for authentication purposes. In some embodiments, method 700 may determine whether an account placing a wager is at a particular location by requesting and crosschecking a code that was broadcasted at that particular location. In some embodiments, method 700 may determine whether an account placing a wager is watching the event live by requesting and crosschecking a code, such as a QR code, that was broadcasted during the event. For example, a QR code may be displayed on a television set during an event. In some embodiments, a GPS location from the device placing the wager may be requested.

In some embodiments, method 700 may determine whether a user making a wager submission bought tickets from a particular ticketing service by checking for ticket purchases on a third-party server. One of skill in the art reading this disclosure would know of other like methods of determining whether some and/or all of the factors discussed with process 702 are met.

In some embodiments, process 703 may include communicating instructions to one or more broadcasting devices at a stadium or other event locations to broadcast a code and/or a software configuration. The wager configuration module may allow devices which receive the broadcast code or configurations access rights to create certain wagers and/or place certain wagers, as discussed above.

In some embodiments, process 703 may instruct one or more broadcasting devices to display and/or transmit a ID, code, link, and/or QR code for users to apply to one or more user devices. Wagering configuration module may allow/unlock/enable devices which received and/or applied the ID, code, link, and/or QR code to create and/or place wagers that have access restrictions.

Method 700 may include process 704 in which the method 700 receives a wager configuration. The wager configuration may be received from a user device through a network connection, such as the network connections discussed in FIG. 1-6. In some embodiments, the wager may be in the form of a signal and/or instructions. The wager configuration may include information about the wager such as, who (which may be confirmed through a third-party server of a social media network) or what devices can access the wager, how much is being wagered, what is being wagered, how many people may accept or join the wager, the odds being provided by the wager, the rules and/or the triggering events of the wager, time limits, and/or other information delimiting a wager. In some embodiments, some or all of the wager configurations may be sent to an odds module, such as odds module 452 of FIG. 4. In some embodiments, process 703 may occur after process 704 and may be based on the received wager configuration. In some embodiments, the received wager configuration may be a signal and/or an instruction.

Method 700 may include process 705 in which a wager configuration is broadcast, such as the wager received in process 704. Process 705 may send an update to a GUI on a user device to display a wager in a list of wagers. In some embodiments, Process 705 may only display wagers in user devices which have access rights to view the wager.

Method 700 may include process 706 in which a wager, an indication of acceptance to a wager configuration, a wager submission, and/or an access request is received for one or more wager configurations. In some embodiments this may include accepting of a wager based on a wager configuration, such as the wager configuration received at process 704. In some embodiments, the wager submission and/or the access request may be accompanied by a code and/or configuration. In some embodiments, the code and/or configuration received may be a code and/or configuration that a user device received from a broadcast of a broadcasting device.

Method 700 may include an access rights check 707 to ensure that a wager submission, such as the wager submissions received at process 706 has the appropriate access rights before accepting and/or allowing placement of the wager. In some embodiments, access rights might be granted when a device has a particular configuration and/or code. In some embodiments, granting access rights grants access to features on a website and/or software application which allow for a wager and/or other features. When a wager submission is without the correct access rights, method 700 may return an error at process 708. Otherwise, method 700 may check for sufficient funds at process 709. When there are insufficient funds, method 700 may return an error at process 708. Otherwise wager configuration module may place and record the wager to a storage module, such as storage module 460 of FIG. 4, at process 710 and update an odds module, such as odds module 452 of FIG. 1. In some embodiments, an additional submission or signal requesting submission of a wager may be received before processes 707 and/or 709 are conducted.

Figure 8:
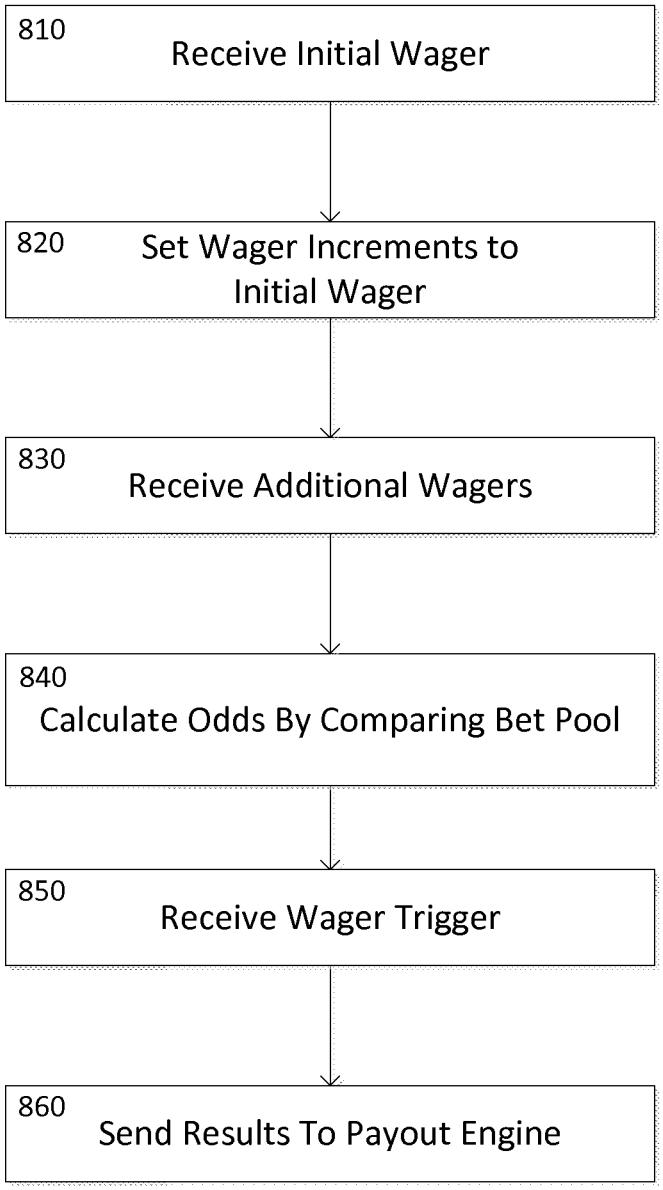
FIG. 8 is a flow chart of an example wager odds determination method that may be implemented by the odds module of FIG. 4.

FIG. 8 is a flow chart illustrating an embodiment of a method 800 that may be included in an implementation of an odds module, such as odds module 452 of FIG. 4. Method 800 may include process 801 wherein the odds module receives an initial wager. In some embodiments, the initial wager may be a part of the configuration received at process 704 in FIG. 7. The initial wager may include an indication that the odds for the wager are to be handled or automated by the odds module. The wager configuration may include triggering events for settling a wager. In some examples, the triggering event may be based on a binary outcome and wagers may be made on either outcome.

Method 800 may include process 820 which sets wager increments to the value of the initial wager. For example, if the initial wager was a unit of 10, method 800 may request wagers in units of 10. Method 800 may also set the initial odds to be 1 to 1.

Method 800 may include process 830 wherein additional wagers are received. In some embodiments, these wagers may be received from one or more users through one or more user devices, such as the user devices discussed in FIG. 3. The wagers may have user accounts associated with the wagers that identify the user placing the wager. In some embodiments, the amount of a currency wagered by a user account may be removed from the user account and placed in escrow as part of a betting pool.

Method 800 may include process 840 in which odds are changed or calculated by comparing the number of bets on each side of a wager proposal. For example, if there are 2 bets on a win and 3 bets on a loss, the betting odds for the win may be 2 to 3. In some embodiments the odds may continue to change until wagering entries are closed. In some embodiments, method 800 may provide the odds to one or more user devices for display.

Method 800 may include process 850 wherein results for the wagers may be received. In some embodiments, method 800 may receive an indication that wagering has ended from a third-party server which provides event statistics. In some embodiments the indication that a wager has ended may be triggered by a bet settlement trigger which may include one or more statistics, such as a player's score and/or end of first quarter, received from a statistics provider.

Method 800 may include process 860 wherein the prize pool value, winning participants, and the winnings for each participant may be determined and sent to a payout module, such as awards module 453 of FIG. 4.

Figure 9:
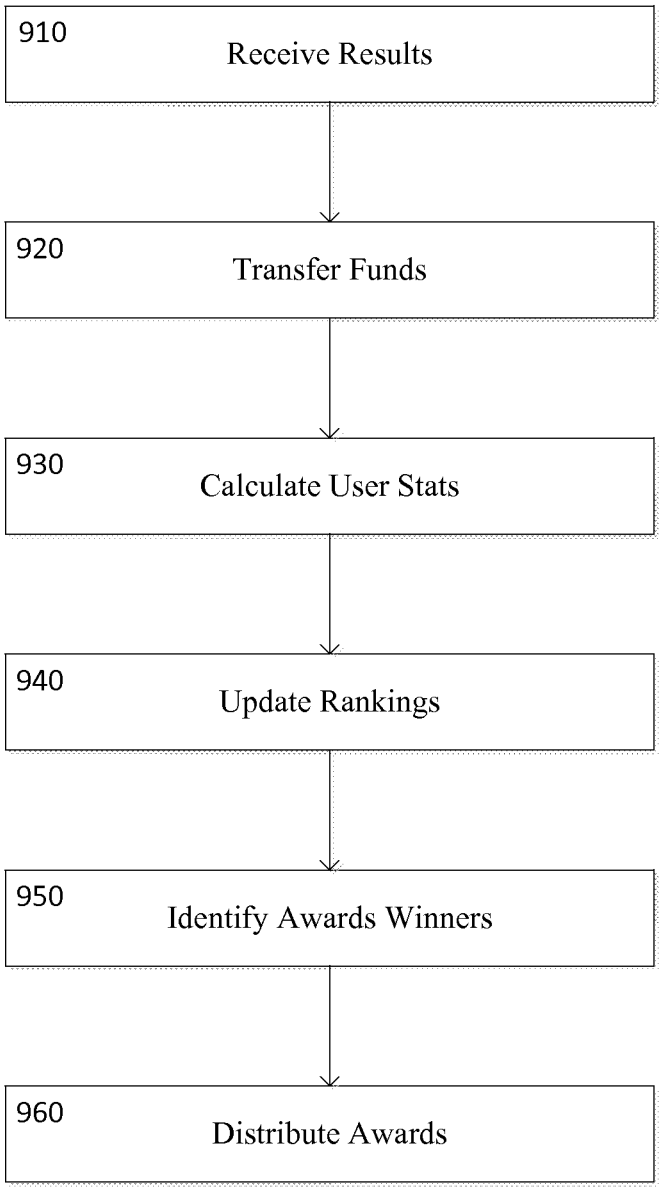
FIG. 9 is a flow chart of an example wager settlement method that may be implemented by a payout module.

FIG. 9 is a flow chart illustrating an embodiment of a method 900 that may be included in an implementation of a payout module, such as awards module 453 of FIG. 4.

Method 900 may include process 910 in which results of a wager are received from an odds module such as odds module 452 of FIG. 4. In some embodiments, the results from the odds module may include information on which users won on a wager, the winning amount, and/or other related information.

Method 900 may have process 920 in which the winning funds are transferred to one or more user accounts that won a wager. In some embodiments, the wager may be taken from a betting pool held in escrow when wagers were initially made. In some embodiments, a wager exchange may occur where wager amounts may be taken out of accounts from one or more users who lost the wager and transferred to users who won the wager. In some embodiments, this exchange may be based on the signal triggering a bet settlement trigger, such as an event statistic.

Method 900 may include a process 930 in which a ranking chart is updated among users within a group. The rankings may be part of a competition set up by one or more users that may include prizes for one or more highest ranked users, such as the top 10%, the top three highest ranked users, and/or other prize pool structures. In some embodiments, the rankings of the users may be based on a holding of a virtual currency, for example, a higher rank may be given to individuals with higher quantities of the virtual currency. In some embodiments, the rankings may be based on total winnings within a given time period.

Method 900 may have process 950 in which a competition ends and the winners of the competition are identified. In some embodiments, a competition may end based on a time limit and winners may be determined by rank, such as top 10%, top three users, and/or other prize pool structures.

Figure 10:
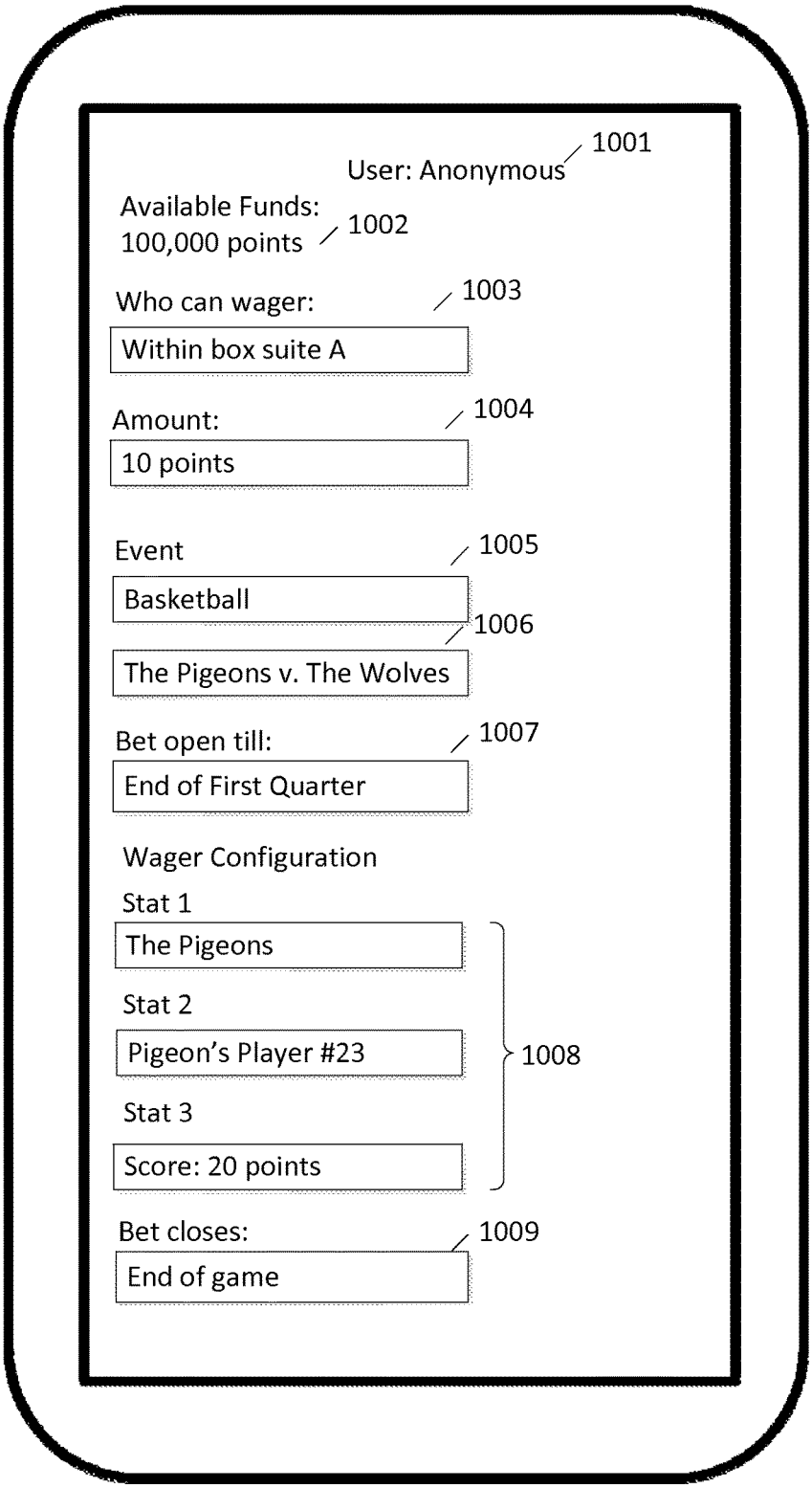
FIG. 10 is a diagram of an example graphical user interface that may be displayed on a user device for interacting with the socially interactive wagering system.

Method 900 may have process 960 in which the awards are distributed to the one or more winning individuals. In some embodiments, the awards may be currency and award may be electronically sent to a user's account. In some embodiments, the awards may be tickets to an event, event paraphernalia, and/or any other commodity FIG. 10 illustrates an example GUI 1000 on a client device that may allow a user to configure a wager on a wagering server such as wagering server 302 of FIG. 3 and wagering server 400 of FIG. 4. In some embodiments GUI 1000 may be provided by a webserver from a wagering server, and the GUI may be displayed on a user device, such as the user device discussed in FIG. 1-3, through a web browsing application on the user device. In some embodiments the GUI may be displayed on a client device through an application installed on the client device and may interact with and/or be controlled by a wagering server.

In some embodiments, GUI 1000 may display a user's username 1001, and the user's available funds 1002. In some embodiments, GUI 1000 may provide the user with a drop down menu 1003 that allows the user to limit who many accept the wagers. In this example, the wagers can only be accepted by people within box suite A. In some embodiments, GUI 1000 may allow the user to make multiple limitations (not shown). An example of multiple limitations may be people in the restaurant and people who are friends on a social media website such as Facebook®. GUI 1000 may provide an interface 1004 in which a user may enter in the amount the user wishes to wager. In some embodiments, GUI 1000 may provide additional drop down menus to enable a user to configure the wager such as event type 1005 and particular event 1006, how long the wager is open for 1007 (this may be a time limit), and the limits of the wager 1008. The limits of the wager 1008 may have several drop down menus which may display until the limits for a wager are sufficiently defined, such as the team, additional team stats or whether that team will win or lose. For example if a team is selected, a drop down menu may request the selection of win, lose, or a team member. If a team member is chosen, an additional drop down menu for a player stat may be provided, such as the number of points the player will score.

The GUI may also have a drop down menu 1009 that allows a user to select or enter in a time limit or how an indefinite wager ends, such as end of the game.

Where applicable, various embodiments provided by the present disclosure may be implemented using hardware, software, or combinations of hardware and software. Also, where applicable, the various hardware components and/or software components set forth herein may be combined into composite components comprising software, hardware, and/or both without departing from the scope of the present disclosure. Where applicable, the various hardware components and/or software components set forth herein may be separated into sub-components comprising software, hardware, or both without departing from the scope of the present disclosure. In addition, where applicable, it is contemplated that software components may be implemented as hardware components and vice-versa.

Software, in accordance with the present disclosure, such as program code and/or data, may be stored on one or more computer readable mediums. It is also contemplated that software identified herein may be implemented using one or more general purpose or specific purpose computers and/or computer systems, networked and/or otherwise. Where applicable, the ordering of various steps described herein may be changed, combined into composite steps, and/or separated into sub-steps to provide features described herein.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. For example, the above embodiments have focused on merchants and customers; however, a customer or consumer can pay, or otherwise interact with any type of recipient, including charities and individuals. The payment does not have to involve a purchase, but may be a loan, a charitable contribution, a gift, etc. Thus, merchant as used herein can also include charities, individuals, and any other entity or person receiving a payment from a customer. Having thus described embodiments of the present disclosure, persons of ordinary skill in the art will recognize that changes may be made in form and detail without departing from the scope of the present disclosure. Thus, the present disclosure is limited only by the claims.

What is claimed is:

1. A wagering system, comprising:

memory configured to store machine-readable instructions; and a processor coupled to the memory, wherein the processor is configured to execute the machine-readable instructions stored in the memory to cause the wagering system to perform operations, the operations comprising:

providing to a first user device a user interface including a menu configured to allow the first user device to generate a wager based on a selection of a plurality of narrowing limitations in the menu to delineate a wager configuration including a polarized trigger for the wager;

receiving the wager configuration for the wager from the first user device displaying the user interface including the menu;

transmitting to a broadcasting device a first code for broadcasting over a limited wireless transmission range within a venue, the first code based on the wager configuration;

receiving, from a second user device, the wager for an activity in the venue according to the wager configuration and a second code, the second code wirelessly received from a broadcast within the limited wireless transmission range by the second user device and the second code matching the first code when the second user device received the broadcast of the first code; and placing the wager based on the second code matching the first code and the second user device being eligible to engage in the wager based on the wager configuration.

2. The wagering system of claim 1, wherein the polarized trigger includes a selection of a win or a loss for the activity in the venue based on selection of the narrowing limitations in the menu.

3. The wagering system of claim 1, wherein the plurality of narrowing limitations includes a first selection of an event type corresponding to the activity in the venue.

4. The wagering system of claim 3, wherein the plurality of narrowing limitations further includes a second selection of an event of the event type.

5. The wagering system of claim 4, wherein the plurality of narrowing limitations further includes a third selection of a team competing in the event.

6. The wagering system of claim 5, wherein the plurality of narrowing limitations further includes a fourth selection of a player on the team competing in the event.

7. The wagering system of claim 1, wherein the operations further include facilitating communication between the first user device and the second user device while participating in the wager.

8. A wagering system, comprising:

memory configured to store instructions; and one or more processors coupled to the memory and operable to execute the instructions from the memory to cause the wagering system to perform operations, the operations comprising:

providing to a first user device a user interface including a menu configured to allow the first user device to generate a wager for an activity in a venue based on a selection of a plurality of narrowing limitations in the menu to delineate a wager configuration including a polarized trigger for the wager;

receiving the wager configuration for the wager from the first user device, the wager configuration for the wager comprising a first code broadcasted from a broadcasting device;

receiving, from a second user device, a request, to place the wager with the wager configuration and a second code broadcasted from the broadcasting device; and granting the request to place the wager with the wager configuration when the second code broadcasted from the broadcasting device matches the first code.

9. The wagering system of claim 8, wherein the polarized trigger includes a selection of a win or a loss for the activity in the venue based on selection of the narrowing limitations in the menu.

10. The wagering system of claim 8, wherein the plurality of narrowing limitations includes a first selection of an event type corresponding to the activity in the venue.

11. The wagering system of claim 10, wherein the plurality of narrowing limitations further includes a second selection of an event of the event type.

12. The wagering system of claim 11, wherein the plurality of narrowing limitations further includes a third selection of a team competing in the event.

13. The wagering system of claim 12, wherein the plurality of narrowing limitations further includes a fourth selection of a player on the team competing in the event.

14. The wagering system of claim 8, further configured to facilitate communication between the first user device and the second user device while participating in the wager.

15. A non-transitory computer-readable storage medium, the computer-readable storage medium including instructions that when executed by a computer, cause the computer to perform operations, comprising:

providing, to a user device, a user interface including a wager configuration menu configured to allow a user to generate a wager for an activity in a venue based on a selection of a plurality of narrowing limitations in the wager configuration menu to delineate a wager configuration including a polarized trigger for the wager;

receiving the wager configuration for the wager from the first user device displaying the user interface including the menu;

transmitting to a broadcasting device a first code for broadcasting over a limited wireless transmission range within a venue, the first code based on the wager configuration;

receiving, from a second user device, the wager for an activity in the venue according to the wager configuration and a second code, the second code wirelessly received from a broadcast within the limited wireless transmission range by the second user device and the second code matching the first code when the second user device received the broadcast of the first code; and placing the wager when based on the second code matching the first code and the second user device is eligible to engage in the wager based on the wager configuration.

16. The non-transitory computer-readable storage medium of claim 15, wherein the wager configuration comprises one or more selections of one or more narrowing limitations including a first selection of an event type corresponding to the activity, in the venue, a second selection of an event of the event type, a third selection of a team competing in the event, or a fourth selection of a player on the team competing in the event.

17. The non-transitory computer-readable storage medium of claim 15, wherein the user interface further comprises a user-limiting menu configured for limiting one or more other users from accepting the wager.

18. The non-transitory computer-readable storage medium of claim 17, wherein the user-limiting menu comprises selections for limiting the one or more other users from accepting the wager based on differences in locations of the other users.

19. The non-transitory computer-readable storage medium of claim 17, wherein the user-limiting menu comprises selections for limiting the one or more other users from accepting the wager based on social media relationships between the user and the other users.

20. The non-transitory computer-readable storage medium of claim 15, wherein the user interface further comprises a wager duration menu configured for limiting a time for placing the wager.

* * * * *